United States Patent [19]

Hensley et al.

[11] Patent Number: 4,494,701

[45] Date of Patent: Jan. 22, 1985

[54] FUEL INJECTOR

[75] Inventors: Thomas E. Hensley, Newport News; Richard D. Weaver, Williamsburg, both of Va.

[73] Assignee: Allied Corporation, Southfield, Mich.

[21] Appl. No.: 430,190

[22] Filed: Sep. 30, 1982

[51] Int. Cl.[3] ..... B05B 01/30

[52] U.S. Cl. ..... 239/585; 251/139; 251/141

[58] Field of Search ..... 239/585; 251/139, 141

[56] References Cited

U.S. PATENT DOCUMENTS 3,967,597 7/1976 Schlagmüller et al. ..... 239/585 X 4,218,021 8/1980 Palma ..... 251/141 X 4,235,375 11/1980 Melotti ..... 239/585 X

*Primary Examiner*—John J. Love

*Assistant Examiner*—Mary F. McCarthy

*Attorney, Agent, or Firm*—Russel C. Wells

[57] ABSTRACT

A bottom feed fuel injector as used in single point fuel injection systems is fabricated from sintered iron or powdered metal. This reduces secondary machining operations and therefore reduces cost of injectors. Additionally, static adjustments are capable of being made from the end of the injector opposite the discharge end. A top feed injector is described wherein several of its critical elements are molded from sintered iron or powdered metal.

6 Claims, 4 Drawing Figures

FUEL INJECTOR

This invention relates to fuel injectors in general and in particular to fuel injectors fabricated from molded sintered iron or powdered metal.

In prior art fuel injectors such as that shown in U.S. Pat. Nos. 4,254,653, 4,235,375 and 4,232,830 all assigned to the same assignee of this invention, the injectors are fabricated and machined from a low carbon, cold-formed steel, silicon iron stock and other materials needing either or both primary and secondary machining operations. This involves a large capital investment in machinery and equipment necessary to competitively manufacture injectors and at the same time discourages design modifications of injectors for improved performance or greater fuel handling capability.

It is a principle advantage of the present invention to manufacture an injector using powdered metal technology. As a result of this advantage the manufacturing cost of injectors is substantially reduced.

These and other advantages of a molded sintered iron fuel injector, will become apparent in the following detailed description and accompanying drawings in which.

DETAILED DESCRIPTION

Figure 1:
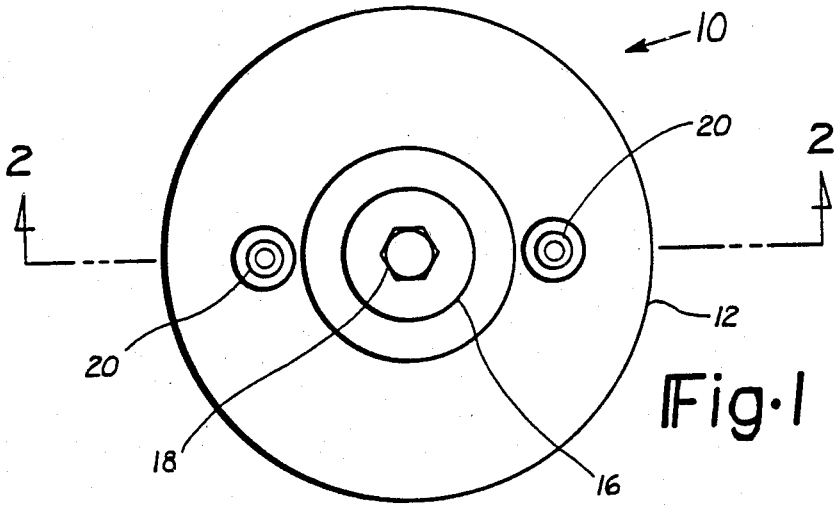
FIG. 1 is a plan view of a bottom feed injector.

Referring to the FIGS. by the reference characters, there is illustrated in FIG. 1 a plan view of an injector 10 that may be used in single point fuel injection systems. The housing 12 has a centrally located aperture 14 from which the tube 16 and an adjusting means 18 extends. Spaced from the tube 16 are a pair of contact terminals 20 which are electrically connected to a solenoid coil 22.

Figure 2:
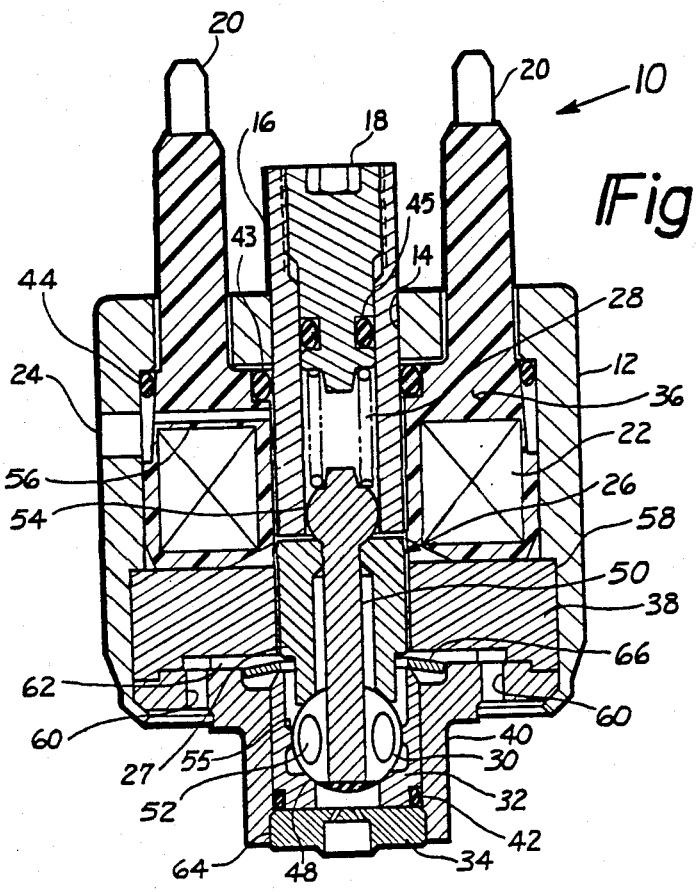
FIG. 2 is a cross-sectional view along a longitudinal line 2—2 of FIG. 1.

FIG. 2 is a cross-sectional view of the preferred embodiment of the injector 10 and is shown in a vertical orientation wherein fuel is supplied to the bottom of the injector 10 adjacent the valve end. This is typically called a "bottom-feed" injector. The same features of this injector 10, as described herein, are applicable to a "top feed" injector wherein fuel is supplied to the top end of the injector and flows through a central fuel passageway to the bottom or valve end of the injector.

The housing 12, as illustrated in FIG. 2, is a tubular member enclosed at one end. The housing 12 is molded from sintered iron or powdered metal and may be impregnated to prevent any fluid leakage or may be fabricated from a solid metal such as low carbon steel. The housing has a vent aperture 24 extending through the wall for venting fuel, trapped air and vaporized fuel from the upper portion of the injector 10. Typically the vent 24 is connected to the fuel return line which is at a pressure which is lower than the pressure of the fuel supplied to the injector 10.

The several elements of the injector, as illustrated in FIG. 2, are the tube member 16, the adjusting means 18, the armature means 26, a bias spring 28, the valve member means 30, the valve seat member 32, a spray tip member 34, a solenoid coil assembly 36, a pole piece member 38, a plate member 40 and several sealing members 42–45.

In the preferred embodiment many of the elements are molded with sintered iron or powdered metal. These elements, when the molding process is completed, may not require any primary or secondary machining operations prior to assembly. As indicated the housing 12 is molded from sintered iron as are the pole piece 38, the plate member 40 and the armature member 27.

The tube member 16 which is a tubular stationary member in the injector is inserted into the central aperture 14 of the housing 12 and once positioned, after the remaining elements are in place, is staked to the housing 12 by a ring staking operation or other fastening means. In prior art injectors, the tube 16 is threaded into the housing 12 and used to adjust for static flow adjustments. However as will be hereinafter illustrated, the spray tip member 34 is used for this function.

Located in the tube member 16 at one end, the end external to the housing member 12, is an adjusting means 18 which is threaded into the inner diameter of the tube member 16 and extends axially into the tube member 16. At the opposite end of the tube member 16 and affixed either to the tube 16 or the armature means 26, is a thin washer member, not shown, to provide for a minimum fixed magnetic gap between the tube member 16 and the armature means 26.

The armature means 26 comprises a valve member means 30 which is secured to an armature member 27 either by projection welding or similar means of fastening. The valve member means 30 may be a ball valve as illustrated having a spherical sealing surface mating with a conical valve seat 48. As illustrated, the ball valve 30 may be secured to an armature member 27 by means of a pin 50 secured to the ball and extending axially through the armature member 27.

The ball valve 30, if it is a full sphere, has a plurality of flats 52 thereon to allow fuel to flow around the ball as will hereinafter be explained. The pin 50 is secured to the ball through an axially extending aperture and headed on the ball. On the opposite end of the pin 50 on the outside of the armature member 27, is an enlarged spherical bearing 54 which is located in a sliding relationship to the inner diameter of the tube member 16. The distance between the spherical bearing 54 and ball valve is such to maintain the ball valve in contact with the armature member 27 so as to move as an integral unit forming the armature means 26. If the ball valve is welded to the armature member 27, the pin 50 may not extend through the ball but will guide the armature means 26 when the solenoid coil assembly 36 is energized and the armature means 26 is magnetically attracted to the tube member 16. In either embodiment, the spherical bearing 54 slides on the inner diameter of the tube member 16.

Interposed the spherical bearing end 54 of the pin 50 and the adjusting member 18, in the inner diameter of the tubular tube member 16, is a bias spring 28 which functions to apply a pressure holding the valve member 30 against the valve seat 48 in valve seat member 32. By means of the adjusting means 18, the operating length of the bias spring 28 is changed which changes the dynamic characteristics of the injector 10.

The valve seat member 32 functions to provide a valve seat 48 for the valve member 30 and has either a plurality of guides 55 or a complete ring guide for locating and aligning the valve member 30 and the valve seat 48. The integration of the guide or guides 55 and the valve seat 48 in one unitary valve seat member 32 provides for required concentricity between the valve member 30 and the valve seat 48. If there are a plurality of spaced guides 55, then the ball member will not be required to have any flat surfaces 52 thereon to provide for the passage of fuel thereby, but if there is a ring guide, then a number of flats 52 must be provided on the ball for the passage of fuel to the valve seat 48.

The solenoid coil assembly 36 contains the several windings of the coil 22 which are terminated at two contact terminals 20. The electrical signal, for operating the injector, is supplied to the two contact terminals 20 to energize the coil 22 causing the armature means 26 to be attracted to the tube member 16 thus lifting the valve member 30 from the valve seat 32. In the preferred embodiment, the coil is encapsulated in a material which is not affected by the fuel controlled by the injector. As illustrated in FIG. 2, the end of the solenoid coil assembly 36 having the contact terminals 20 is tapered to provide a volume for fuel, air or vapor to collect to be discharged from the vent 24. A small tubular passageway 56 extends through the solenoid housing to the inside surface thereof adjacent the tube member 16 to provide means for drawing any fuel, air or vapor from the interior of the injector.

In order to complete the magnetic circuit within the injector, a pole piece member 38 is positioned adjacent the solenoid coil assembly 36 and the armature means 26. The pole piece member 38 is located in a stepped diameter 58 of the housing 12 and additionally functions to hold the solenoid coil assembly 36 against the enclosed end of the housing 12.

A plate member 40 functions to retain the pole piece member 38 against the stepped diameter 58 and to provide a fuel inlet 60 to the injector 10. As the embodiment shown in FIG. 2 is a bottom feed injector, fuel flows through the inlet 60 formed in the plate member 40 to the passageway 62 between the pole piece member 38 and the plate member 40 then, to the interior of the valve seat member 32 by the flats 52 on the ball valve 30 and on to the valve seat 48. The plate member 40 has a coaxially extending aperture which is terminated by a threaded means 64 for locating the spray tip member 34. In assembling the injector 10, the valve seat member 32 is biased by a spring washer 66 against the spray tip member 34 which is threadably secured in the plate member 40.

Several sealing members 42–45 are positioned within the injector 10 to function not only for preventing the flow of fuel to certain areas in the injector but also to function as guide members allowing controlled movement of the several elements. As shown in FIG. 2, there is a first sealing ring 42 between the plate member 40, the spray tip member 34, and the valve seat member 32 to prevent the leakage of fuel from the injector 10. A second sealing ring 43 is positioned between the solenoid coil assembly 36 and the housing 12 to prevent leakage of fuel toward the contact terminals 20. A third sealing ring 44 is positioned around the tube member 16 and located on the solenoid coil assembly 36 inner diameter to prevent leakage of fuel toward the contact terminals 20. A fourth sealing ring 45 is positioned between the adjusting means 18 and the inside surface of the tube member 16 to allow the adjusting means 18 to move and to prevent the leakage of fuel out of the tube member 16.

Figure 3:
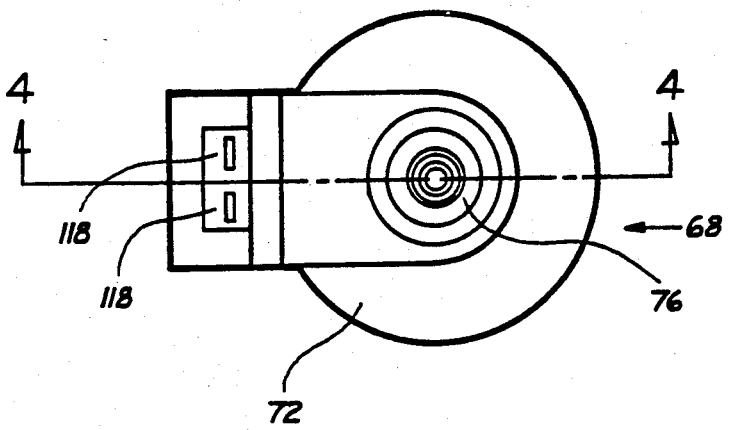
FIG. 3 is a plan view of a top feed injector.
Figure 4:
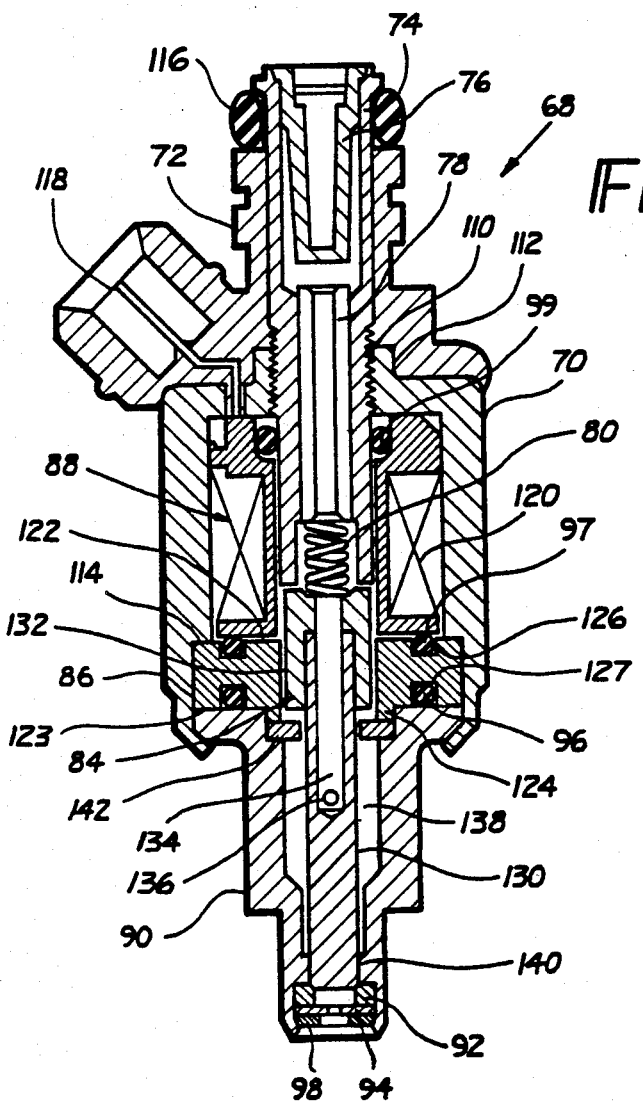
FIG. 4 is a cross-sectional view along a longitudinal line 4—4 of FIG. 3.

When the injector is used in a fuel bowl or in the air stream or a throttle body, the housing 12, the pole piece 38, the plate member 40, and the armature means 26 are molded from sintered iron. This allows the necessary passageways to be formed in the mold by cores and once the parts are molded, many of the secondary machining operations are eliminated. In top feed injectors, as illustrated in FIGS. 3 and 4, the several elements of the injector 68 which typically have fuel only on one side, the molded elements or parts are also fabricated from sintered iron and are impregnated to prevent any leakage through the sintered iron.

Returning back to FIG. 2, in the operation of the injector 10, an electrical signal is supplied to the contact terminals 20 of the solenoid coil assembly 36. Typically, the signal is in the form of pulse wherein the width or time length of the pulse represents a desired quantity of fuel to be discharged from the injector 10. Such a pulse is typically generated in an electronic control unit in response to various signals from the engine and the engine operator.

The signal, when applied to the contact terminals 20, generates a magnetic field from the solenoid coil 22 which operates to attract the armature means 26 to the tube member 16 thereby lifting the valve member 30 off the valve seat 48. Fuel then flows under pressure from the fuel entry inlet 60 in the plate member 40, through the passageway 62 between the plate member 40 and the pole piece member 38, through and around the spring washer 66, down the inner tubular passage of the valve seat member 30 by the flats 52 on ball valve 30 to the valve seat 48. Once the fuel leaves the valve seat 48, it is directed by the spray tip member 34 into an appropriate or desired spray pattern out of the injector 10.

When the electrical signal is removed or terminated, the bias spring 28 operates to force the armature means 26 away from the tube member 16 and the valve member 30 against the valve seat 48 effectively closing the injector.

The injector 10 is calibrated for its flow rate by energizing the solenoid coil 22 to lift the ball valve member 30 from the valve seat 48. The spray tip member 34 is then threadably adjusted to allow the valve seat member 32, to move axially under the biasing of the spring washer 66. This movement either opens or closes the volume between the ball valve member 30 and the valve seat 48. Typically once this adjustment is made, the spray tip member 34 is secured from further movement.

As previously indicated, the dynamic characteristics of the injector 10 are adjusted by means of the adjusting means 18 which operates against the bias spring 28 to apply a spring force against the armature means 26. The heavier the force the longer the opening time and the shorter the closing time.

Referring to FIGS. 3 and 4 there is illustrated a "top feed" injector 68 as is found in multipoint fuel injection systems wherein the fuel is supplied from a fuel source to each injector 68 by means of a fuel rail not shown. The illustrated injector 68 is made according to the invention herein and several of its individual members are fabricated from sintered iron or powdered metal.

The injector comprises a housing 70, a cap member 72, an inlet tube 74, a filter 76, an adjustment tube 78, a bias spring 80, armature means 84, a pole piece member 86, a solenoid coil assembly 88, a body member 90, a valve seat 92, an orifice member 94 and several sealing members 96–99.

The housing 70 is an elongated tubular member having one end substantially enclosed with a threaded aperture 110 therein. The threaded aperture 110 is located in an end boss 112 on the enclosed end of the housing 70 is adapted to threadably receive the inlet tube 74. The other or open end of the housing 70 is adapted to be staked over after assembly of the injector 68 to retain all of the internal components in an integral structure. The inner diameter of the housing 70 is stepped to provide a shoulder 114 near the open end to receive and locate the pole piece member 86.

The inlet tube 74 provides an adjustment to set the static lift of armature means 84 as will hereinafter be explained. Located within the inner diameter of the inlet tube 74 and intermediate its ends is an adjustment tube 78 which cooperates with the bias spring 80 to bias the armature means 84 and the injector valve closed. The outboard end of the inlet tube 74 contains a fuel filter 76 for receiving fuel and the inlet tube on its outside is adapted to retain a sealing ring 116 to sealingly secure the injector 68 to the fuel rail not shown.

Surrounding the inlet tube 74 and within the housing 70 is a solenoid coil assembly 88. The ends of the solenoid windings are connected to a pair of terminals 118 located in a cap member 72. The cap member 72, which is typically a molded nylon part, encloses the end of the housing 70 with the end boss 112 and provides a receptacle for the terminals 118 of the solenoid coil 120.

The length of the solenoid coil assembly 88 and the distance from the enclosed end of the housing 70 to the shoulder 114 are substantially equal. Positioned against the shoulder 114 and located thereby to a pole piece member 86 which encloses the open end of the housing 70 encircling the armature means 84. The pole piece member 86 in the preferred embodiment is a donut shaped member having two broadsides 112, 123 one of which 123 has a central annular ring 124 extending therefrom. On each broadside 122, 123 is a circular groove 126, 127 for receiving the sealing members 96, 97.

The armature means 84 is axially aligned with the inlet tube 74 and is adapted to be magnetically attracted to the inlet tube 74 under the magnetic force created by the energization of the solenoid coil 120. The bias spring 80 is positioned between the end of the adjusting tube 78 and the tube member 74 for spacing the armature means 84 from the end of the inlet tube 74.

In the preferred embodiment as shown in FIG. 4 the armature means 84 comprising an armature shaft 130 fastened to an armature member 132 and axially extends therefrom. As shown, the end of the injector opposite the fuel receiving end, is defined by a tubular body member 90 terminating in a valve seat 92. The armature shaft 130 extends from the armature member 132 to the valve seat 92 and is adapted to sealingly mate with the valve seat 92. Since fuel flows the length of the injector 68, a central fuel passageway 134 extends through the armature member 132 and to a point intermediate the ends of the armature shaft 130 wherein a cross hole 136 directs the fuel to an inner volume 138 of the body member 90.

The inner volume 138 of the body member 90 terminates in a plurality of axially-extending guides 140 to concentrically guide the armature shaft 130 to seat on the valve seat 92. The end of the armature shaft 130 near the armature member 132 is guided by a bearing washer 142 located in the body member by the annular ring 124 on the pole piece member 86.

Depending upon the use of the injector 68, outwardly of the valve seat 92 is an orifice member 94 supported and retained by means of a third sealing member 98 and the end of the body member 90.

A fourth sealing member 99 is positioned between the solenoid coil assembly 88 and the inlet tube 74 adjacent the threaded end boss 112. The function of this sealing member 99 is to prevent fuel from leaking through the end boss 112.

The housing 70, pole piece member 86 and armature member 132 and fabricated from sintered iron or powdered metal to reduce the need for machining. In order to avoid any seepage through these members where fuel is not found on all sides of the member, the molded member is impregnated to seal the pores in the member and to provide a surface which can be plated. The body member 90 is formed of stainless steel or similar material.

When the several elements of the injector 68 are assembled and the injector becomes an integral member, the inlet tube 74 is threaded into the end boss 112 until it no longer turns. When this happens, the armature shaft 130 is located against the valve seat 92 and the armature member 132 and the inlet tube 74 are positioned against each other. The injector 68 is closed tightly and cannot be opened because there is no gap across which the armature member 132 can move to lift the armature shaft 130 from the valve seat 92. In the preferred embodiment, the inlet tube 74 is backed off or turned by a predetermined amount, according to the flow requirements of the injector, and staked or fastened in that position. This angular turn will develop a gap between the armature member 132 and the inlet tube 74 providing a predetermined lift of the armature means 84 from the valve seat 92. The bias spring 80 provides pressure between the armature means 84 and the valve seat 92 holding the valve closed.

We claim:

1. A fuel injector having a tubular housing member enclosed at one end containing a solenoid coil assembly, a tube member extending through an aperture in said enclosed end, and an adjustment means threaded in said tube member, an armature means adapted to be magnetically attracted to the tube member, valve seat means, valve member means responsive to the armature means for moving relative to the valve seat means, and means at the open end of the tubular housing member for receiving fuel into the injector for discharge between the valve member means and the valve seat means under control of the armature means, the injector characterized in that:

the valve means comprises a spherical valve member;

the armature means having a spherical bearing coupled thereto for locating and guiding in the tube member, said spherical valve member means being coupled to said armature means for movement therewith; and the valve seat member being a tubular member having a plurality of guide means for guiding said spherical valve member to a conical valve seat at one end of the tubular member.

2. The fuel injector according to claim 1 wherein said armature means and the housing are fabricated from sintered iron.

3. The fuel injector according to claim 1 or 2 additionally including a pole piece member surrounding the armature means and a plate member encircling said valve seat member and having a spray tip member connected thereto outwardly of said valve seat member wherein said pole piece member and said plate member are fabricated from sintered iron.

4. The fuel injector according to claim 1 further including a bias spring means and wherein the armature means and the valve means is an integral structure with said spherical valve member at one end and the spherical bearing member at the other end and the valve seat means having a plurality of spaced apart guides cooperating with said spherical valve member for guiding and locating said spherical valve member on said conical valve seat when the solenoid coil is de-energized and in response to said bias spring means.

5. A fuel injector having a tubular housing member enclosed at one end with an aperture therein, an inlet tube extending through the aperture to a point intermediate the length of the housing member, armature means axially aligned with the inlet tube, a solenoid coil assembly, a pole piece member having an axially extending aperture and an elongated body member terminating in a valve seat, the fuel injector characterized in that:

the armature means includes an armature shaft terminating in a valve member for mating with the valve seat and an armature member extending into the pole piece member aperture for magnetically moving said armature means toward the inlet tube when the coil is energized;

a bias spring means for biasing the armature means away from the inlet tube when the coil is de-energized;

a bearing washer mounted in the body member for guiding said armature shaft during movement thereof; and a plurality of axially-extending circumferentially spaced guides mounted in the body member concentric with the valve seat, said guides axially spaced from said bearing washer;

said bearing washer and said guides for concentrically guiding said armature shaft in response to energization of the solenoid coil to lift said valve member from said valve seat and in response to said bias spring when the solenoid coil is de-energized.

6. The fuel injector according to claim 5 wherein said housing member, said pole piece member, and said armature member are fabricated from sintered iron.

* * * * *